US006390964B1

(12) United States Patent
Mackel

(10) Patent No.: US 6,390,964 B1
(45) Date of Patent: May 21, 2002

(54) DEVICE FOR COOLING A CENTRIFUGAL DEVICE AND METHOD FOR CENTRIFUGE OPERATION

(75) Inventor: Wilfried Mackel, Oelde (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 09/674,130

(22) PCT Filed: Feb. 26, 2000

(86) PCT No.: PCT/EP00/01607

§ 371 Date: Oct. 27, 2000

§ 102(e) Date: Oct. 27, 2000

(87) PCT Pub. No.: WO00/69567

PCT Pub. Date: Nov. 23, 2000

(30) Foreign Application Priority Data

May 14, 1999 (DE) ..... 199 22 237

(51) Int. Cl.[7] ..... B04B 15/02
(52) U.S. Cl. ..... 494/14; 494/26; 494/27
(58) Field of Search ..... 494/1–4, 13, 14, 494/46, 26, 68–73, 27; 210/175, 177

(56) References Cited

U.S. PATENT DOCUMENTS 2,905,380 A * 9/1959 Matthews, II
2,955,754 A * 10/1960 Nyrop
3,167,509 A * 1/1965 Steinacker
3,539,096 A * 11/1970 Lewis et al.
3,749,303 A * 7/1973 Hemfort
3,981,437 A * 9/1976 Hemfort et al.
4,113,172 A * 9/1978 Pautsch et al.
4,305,817 A * 12/1981 Kohlstette
5,800,330 A * 9/1998 Modeer ..... 494/2

FOREIGN PATENT DOCUMENTS

| | | | |
|---|---|---|---|
| DE | 617703 | * | 8/1935 |
| DE | 1062631 | * | 7/1959 |
| DE | 2631110 | * | 1/1978 |
| DE | 2822478 | * | 12/1978 |
| FR | 1598924 | * | 7/1970 |

* cited by examiner

*Primary Examiner*—Charles E. Cooley
(74) *Attorney, Agent, or Firm*—Barnes & Thornburg

(57) ABSTRACT

The invention relates to a centrifuge and to a method for operating the centrifuge. The centrifuge comprises a centrifugal drum, an inflow tube leading into the centrifugal drum for feeding a centrifugal material into the centrifugal drum, and a valve mechanism, which can be acted upon by control fluid, for cooling the centrifugal drum. The control fluid is cooled such that it acts as a cooling medium.

12 Claims, 1 Drawing Sheet

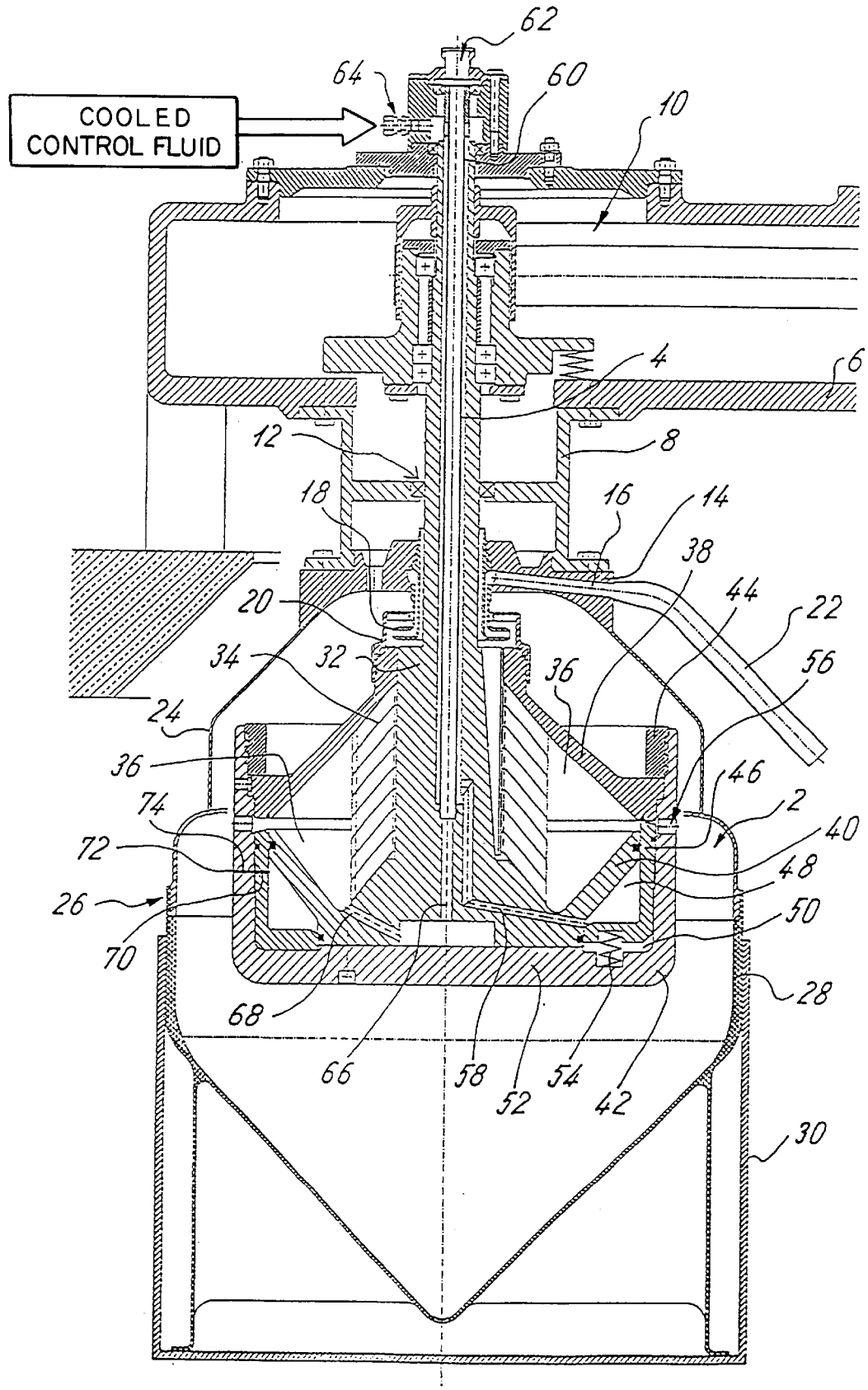
COOLED
CONTROL FLUID
62
64
60
10
4
6
12
8
18
16
14
38
44
22
20
34
32
36
56
24
36
46
74
2
40
72
48
26
50
70
28
68
66
58
54
52
42
30

DEVICE FOR COOLING A CENTRIFUGAL DEVICE AND METHOD FOR CENTRIFUGE OPERATION

BACKGROUND AND SUMMARY OF THE INVENTION

The invention relates to a centrifuge comprising a centrifugal drum, an inflow tube leading into the centrifugal drum for feeding a centrifugal material into the centrifugal drum, and a device for cooling the centrifugal drum. The invention also relates to a method for operating a centrifuge according to the invention.

A centrifuge-of the above-mentioned type is known from German Patent Document DE OS 26 31 110. This document shows a centrifuge with a cylindrical solid-wall centrifugal drum whose shell can be continuously cooled by an insert arranged in the solid-material space by a circulating cooling medium. The insert is supported at several points in the drum shell and is guided in a sealing manner with respect to the separation space of the drum.

Although this cooling system is operable, a, problem arises with respect to the constructive expenditures required for achieving a cooling of the centrifugal drum. The expenditures excessively increase the costs for the manufacturing of the centrifuge particularly at lower cooling requirements.

German Patent Document DE PS 24 23 319 shows a centrifuge with a cylindrical solid-wall centrifugal drum whose shell can be continuously cooled by a circulating first cooling medium. The cooling medium leaves the drum shell at a radially exterior point and is thrown against a shell which is fixed to the frame and surrounds the drum. The shell fixed to the frame, in turn, can be additionally continuously cooled by a second cooling medium. This cooling system has also been successful but also excessively increases the costs for the manufacturing of the centrifuge in the case of lower cooling requirements.

Based on this state of the art, the invention aims at providing a centrifuge and a method for operating the centrifuge by means of which a cooling of the centrifuge can be implemented at low constructive expenditures.

In particular, the cooling should also be usable in the case of centrifuges with an automatic valve mechanism.

The invention achieves this goal. Accordingly, the cooling device includes and uses an outlet valve mechanism of the centrifugal drum which can be operated by a control fluid. The control fluid is cooled such that it acts as a cooling medium. The invention therefore surprisingly uses the valve mechanism of the centrifugal drum also as a cooling device. A separate cooling device is no longer required.

A cooling effect can particularly advantageously be achieved in that cooled sterile air is used as a control fluid. The cooling device, which includes control fluid connections, control fluid paths, an outlet valve mechanism and bores or passages, enables cooled control fluid to pass through the valve mechanism to cool the drum and its collected contents. During the centrifuging operation of the centrifuge, the valve mechanism is acted upon by a first sterile-air flow-through rate and, during an opening of a piston slide valve or control valve mechanism, is acted upon by a second sterile-air flow-through rate which is larger than the first flow-through rate. The first flow-through rate achieves a first cooling effect but does not yet displace the piston slide valve. On the contrary, this displacing is not implemented before the second flow-through rate.

Particularly preferably, sterile air is used as the control fluid because it is reasonable in price and can be handled in a particularly uncomplicated manner. As an alternative, other gaseous media can also be selected.

From German Patent Document DE 28 22 478, a centrifuge is known which comprises a centrifugal drum which has a piston slide valve to which a closing chamber is assigned which, by way of ducts in a spindle, is connected with a hydraulic system. The inflow of the product takes place from above by a central inflow tube. The spindle is situated on the underside of the centrifugal drum. This construction has been successful but reaches its limit when, for reasons of hygiene, the product range is to be situated separately from the driving range of the centrifuge and the control elements of the drive as well as the control elements of the control fluid supply outside the drum (valves, etc.).

This is the start of a further idea of the invention of assigning the feeding duct for the control fluid directly to the inflow tube for the centrifugal material. Because the control fluid feed line and the centrifugal material feed line are thus jointly guided into the centrifugal drum and preferably also extend directly side-by-side, a constructively separate feeding of the control fluid can be avoided.

The invention is particularly suitable for a centrifuge, in the case of which the centrifugal drum hangs on a centrifuge frame, the inflow tube for the centrifugal material and the feeding duct for the control fluid extending jointly from above into the centrifugal drum. In the case of centrifuges with hanging centrifugal drums, a separate feeding of the control fluid from below into the drum is not practical because it may be necessary to collect the solids separated during the separation process below the drum in a sterile vessel. This is clearly simplified by feeding the control liquid "from above".

According to a particularly preferred embodiment of the invention, a double wall is constructed on the inflow tube. The interior tube, for example, is used for feeding the centrifugal material and the conically exterior tube section is used as a feeding device for the control fluid. A double-walled tube is particularly space-saving. In addition, the interior inflow tube for the centrifugal material is cooled in the simplest manner by the fluid in the exterior tube section. Another advantage of this solution is the fact that a separate control air feeding device in the manner of a spindle is avoided.

Preferably, the control air supply also has the purpose of actuating a displaceable piston slide valve for opening and closing solid-matter removal openings in the centrifugal drum. In this case, an opening chamber and a closing chamber adjoin the piston slide valve. By the pressurization by the control fluid, the piston slide valve is moved, in which case it is also possible to hold the piston slide valve in a spring-tensioned manner in one of its working positions and to move it into the respective other working position by the pressure buildup in the corresponding control chamber.

Particularly preferably, according to another variant of the invention, the control and cooling medium is guided through an outlet opening in the drum wall into a solid-matter collecting container in order to cool the collected solids as well as preferably also the rotating drum itself, on which frictional heat is generated by the rotation of the drum. In this case, the control pressure can be selected such that the corresponding working position is maintained despite the "leakage" through the outlet opening.

The opening in the drum wall can also be used for draining a cleaning medium guided into the control fluid paths of the centrifuge.

Summarizing, the invention also implements a space-saving automatic valve mechanism which can also be used for the cooling.

Other objects, advantages and novel features of the present invention will become apparent from the following detailed description of the invention when considered in conjunction with the accompanying drawings.

BRIEF DESCRIPTION OF THE DRAWINGS

The FIGURE is a sectional view of a centrifuge according to the invention having a piston slide valve which, in the left section of the drawing, is illustrated in its opening position and, in the right section, in its closed position.

DETAILED DESCRIPTION OF THE PREFERRED EMBODIMENT

It is noted that the terms used in the following, such as "on the bottom", "on the top", refer to a centrifuge in the case of which the inflow tube is essentially vertically aligned and the centrifugal drum hangs on the bottom on a centrifuge frame. However, these terms should by no means be interpreted to be limiting.

The Figure illustrates a centrifuge which is constructed as a separator and which, in a manner known per se, has a centrifugal drum 2 (which is only outlined and is attached toward the bottom) for the separation of a centrifugal material into various components. The centrifugal material or the centrifugal liquid is guided from above in the downward direction through a central inflow tube 4 into the centrifugal drum 2.

The centrifugal drum 2 is suspended on a centrifuge frame 6 with a lower frame attachment 8. The driving section 10 of the centrifuge (which is well known and therefore is not illustrated in detail) is arranged above the centrifugal drum 2 and/or on the centrifuge frame 6 and is sealed by a sealing section 12 (which is also not shown in detail) in the frame attachment 8 against the centrifugal drum 2. The centrifugal drum 2 is therefore clearly separated constructionally from its driving section 10 and its control elements.

A container lid 14 is mounted on a flange on the lower end of the frame attachment 8. The container lid 14 is penetrated in the center by the inflow tube 4. The container lid 14 has an essentially radially constructed bore 16 which is used as a draining duct for a liquid phase from the centrifugal drum 2 which is diverted by a separating disk 18 from a separating chamber 20. The bore 16 leads into a drainage tube 22.

An upper container shell 24 surrounds the centrifugal drum 2 in its upper area and is used as an upper end of a conical container 26 for receiving solids. The shell 24 is molded to the container lid 14, and a lower section 28 of the container 26 can be removed in the downward direction from the centrifuge and stands in a container frame 30.

The actual centrifugal drum 2 has a distributor 32 which surrounds the inflow tube 4—which in practice is preferably implemented in several parts and is illustrated here in a simplified manner in one piece. The distributor 32 has a plate package 34 attached on the outside on the distributor 32. The plate package 34 is situated in a centrifugal space 36 which conically narrows toward the top and toward the bottom and which is bounded toward the top by a conically shaped drum lid 38 and toward the bottom by a conically extending centrifugal space bottom 40 molded at the bottom to the distributor 32. The drum lid 38 is inserted into a drum bottom part 42 and is screwed together with a closing ring 44 in the drum bottom part 42.

Between the centrifugal space bottom 40 and the lower housing wall of the drum bottom part 42, a displaceably guided, ring-shaped piston slide valve or outlet valve mechanism 46 is arranged. The piston slide valve 46 has an essentially L-shaped wall cross-section which is adjoined in the upward direction by an opening chamber 48 and in the downward direction by a closing chamber 50. The lower wall of the drum bottom part 42 is used as a lower closing chamber bottom 52. Between the lower wall of the piston slide valve 46 and the closing chamber bottom 52—thus, in the closing chamber 50-, closing springs 54 are arranged. The closing springs 54 hold the piston slide valve 46 in its closed position in which it closes off the solid-matter outlet openings 56 in the outer shell of the bottom part 42 of the drum (right part of the Figure).

The opening chamber 48 is constructed between the piston slide valve 46 and the lower wall of the distributor 32 and the centrifugal space bottom 40. The control fluid supply into the opening chamber 48 is by a control fluid feed line 58 in the distributor 32.

The control fluid feed line 58 leads into a ring-shaped feeding duct 60, which surrounds the inflow tube 4, between the interior wall of the distributor 32 and the inflow tube 4 inserted into the distributor 32. In this case, the interior wall of the distributor 32 and the wall of the inflow tube 4 form a type of "tube with a double wall". The actual feeding duct 60 for the control fluid concentrically surrounds the inflow tube 4 for the centrifugal material.

Above the upper end area of the centrifuge frame 6, an axial connection 62 permits the feeding of the centrifugal material into the inflow tube 4. A control fluid feed line connection 64 is used for feeding the control fluid—particularly the feeding of sterile control air—into the feeding duct 60 surrounding the inflow tube.

The operation of the centrifuge of the Figure takes place as follows:

The feeding of the centrifugal material takes place through the connection 62 and the inflow tube 4 as well as through the axial bore 66 of the distributor 32 and a bore 68, which extends essentially radially here, in the centrifugal space bottom into the centrifugal space 36. Solids are removed from the centrifugal space 36 through the openings 56; liquid phases are removed through the separating chamber 20 with the separating disk 18.

Control air (or another gas) is guided as a control fluid through the connection 64 into the feeding duct 60 concentrically surrounding the inflow tube 4. From there, the control air flows into the control fluid feed line 58 and from there into the opening chamber 48. As a result, in the case of a corresponding large pressure buildup in the opening chamber 48, the piston slide valve 46 is pressed against the spring force of the closing springs 54 in the downward direction, which opens up the solid-matter outlet openings 56 (left section of the FIGURE). In contrast, a lowering of the pressure in the opening chamber 48, because of the spring force of the closing springs, results in a displacement of the piston slide valve 46 in the upward direction, which closes the solid-matter outlet openings 56 again.

The piston slide valve 46 and the exterior wall of the centrifugal drum 2 have through bores 70, 72, which interact with one another in one of the working positions of the piston slide valve 46 and can be closed off by a stopper 74. After the removal of the stopper, a simple possibility is created for cleaning the control fluid paths or ducts (60, 58, 48) as well as other centrifuge elements, for example, by means of a rinsing liquid or a rinsing gas, for example, for a particularly uncomplicated implementation of a CP (cleaning-inplace) operation. The bores 70, 72 may also have a nozzle-type design such that, as a result of the outflow of the cooled control fluid into the container 26, a cooling of the collected solids as well as of the drum 2 takes place.

The cooling effect is achieved in that cooled sterile air is used as the control fluid. The cooling device, which includes the connection 64, the control fluid paths 60, 58, 48, the piston slide valve or outlet valve mechanism 46 and the bores or passages 70, 72 enables the cooled control fluid to pass through the valve mechanism to cool drum 2 and its collected contents. During the centrifuging operation, the cooled control fluid is fed in through connection 64, into duct 60 and then into the ducts or controlled fluid paths 58, 60, 48 which are acted upon by a first sterile-air flow-through rate. This first flow-through rate achieves a cooling effect, but does not yet displace the piston slide valve 46. On the contrary, this displacement is only implemented by means of a clearly higher second flow-through rate, which opens the valve 46 and permits the fluid flow through bores 70, 72.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A centrifuge comprising a centrifugal drum, an inflow tube leading into the centrifugal drum for feeding a centrifugal material into the centrifugal drum, an exterior and an interior tube wall constructed on the inflow tube, a ring space between the exterior and the interior tube wall being a feeding duct for a control fluid, an outlet valve mechanism, a device for cooling the centrifugal drum, and wherein the cooling device includes the outlet valve mechanism of the centrifugal drum which can be operated by the control fluid, the control fluid being cooled such that it acts as a cooling medium.

2. The centrifuge according to claim 1, wherein the valve mechanism of the centrifugal drum comprises a displaceable piston slide valve for opening and closing solid-matter removal outlets in the centrifugal drum and an opening chamber and a closing chamber as well as feed lines to these chambers.

3. The centrifuge according to claim 2, between the feeding duct and the opening chamber, a control fluid feed line is constructed in a distributor of the centrifugal drum.

4. The centrifuge according to claim 2, wherein the piston slide valve and/or the exterior wall of the centrifugal drum have passage bores which in one of the working positions of the piston slide valve, interact with one another and can be closed.

5. A method for operating a centrifuge, the centrifuge having a centrifuge drum;

an inflow tube leading into the drum for feeding a centrifugal material into the drum;

a device for cooling the drum wherein the cooling device includes an outlet valve mechanism of the drum which can be operated by a control fluid that, when cooled, is a cooled control fluid or cooling medium, comprising the step of guiding the cooling medium for cooling the centrifuge through the valve mechanism.

6. The method according to claim 5, wherein a cooled gaseous medium is used as a combined control fluid and cooling medium.

7. The method according to claim 6, wherein sterile air is used as the gaseous medium.

8. The method for operating a centrifuge according to claim 5, further including the steps of during the centrifuging operation of the centrifuge, the valve mechanism is acted upon by a first control fluid volume flow; and, during an opening of the valve mechanism, is acted upon by a second control fluid volume flow which is larger than the first volume flow.

9. The method according to claim 5, wherein the cooling device includes control fluid paths and wherein the method further includes the step of cleaning of control fluid paths and/or of other centrifuge elements by guiding a rinsing fluid or a rinsing gas through the control fluid paths.

10. The method according to claim 5, wherein the cooled control fluid or cooling medium is guided through an outlet opening in the drum wall into a solid-matter collecting container in order to cool the collected solids.

11. A centrifuge comprising a centrifugal drum, an inflow tube leading into the centrifugal drum for feeding a centrifugal material into the centrifugal drum, an outlet valve mechanism, a device for cooling the centrifugal drum, wherein the cooling device includes the outlet valve mechanism of the centrifugal drum which can be operated by a control fluid, the control fluid being cooled such that it acts as a cooling medium and wherein the valve mechanism of the centrifugal drum has a feeding duct for the control fluid which is connected to the inflow tube for the centrifugal material.

12. The centrifuge according to claim 11, wherein the centrifugal drum is suspended on a centrifugal frame, and the inflow tube for the centrifugal material and the feeding duct for the control fluid extend jointly from above into the centrifugal drum.

* * * * *